US005740691A

United States Patent [19]

Kovarovic et al.

[11] Patent Number: 5,740,691

[45] Date of Patent: Apr. 21, 1998

[54] HEMMING MACHINE

[75] Inventors: Josef Kovarovic, Hinckley; John Ralph Kowalewsky, Solihull, both of United Kingdom; Gerrit Wesley Sloat, Grand Blan, Mich.

[73] Assignee: Western Atlas U.K. Limited, United Kingdom

[21] Appl. No.: 687,503

[22] PCT Filed: Feb. 13, 1995

[86] PCT No.: PCT/GB95/00289

§ 371 Date: Jul. 29, 1996

§ 102(e) Date: Jul. 29, 1996

[87] PCT Pub. No.: WO95/21711

PCT Pub. Date: Aug. 17, 1995

[30] Foreign Application Priority Data

Feb. 14, 1994 [GB] United Kingdom ..... 9402759
Feb. 18, 1994 [GB] United Kingdom ..... 9403129

[51] Int. Cl.[6] ..... B21D 39/02

[52] U.S. Cl. ..... 72/306; 72/315; 72/323; 29/243.58

[58] Field of Search ..... 72/323, 312–315, 72/306, 450; 29/243.58

[56] References Cited

U.S. PATENT DOCUMENTS

| | | | |
|---|---|---|---|
| 3,092,057 | 6/1963 | Warshilek | 29/243.58 |
| 3,147,726 | 9/1964 | Tribe | 29/243.58 |
| 3,466,661 | 9/1969 | Phillips | 113/1 |
| 3,598,073 | 8/1971 | Denis | 113/54 |
| 4,346,579 | 8/1982 | Takatsu | 29/243.58 |
| 4,706,489 | 11/1987 | Dacey | 29/243.58 |
| 5,038,597 | 8/1991 | Dorsett | 29/243.58 |
| 5,086,638 | 2/1992 | David | 72/451 |

FOREIGN PATENT DOCUMENTS

| | | | |
|---|---|---|---|
| 686651 | 7/1930 | France | 72/323 |
| 2 645 053 | 10/1990 | France . | |

*Primary Examiner*—Daniel C. Crane
*Attorney, Agent, or Firm*—Lee, Mann, Smith, McWilliams, Sweeney & Ohlson

[57] ABSTRACT

A press is described for prehemming and final hemming the internal periphery of an aperture in sheet material received on an anvil (10) on which the sheet material (12) is held down so that the upturned edge (14) of the aperture which is to be hemmed is substantially in alignment with the edge of the opening in the anvil (10). A composite hemming tool (40, 42) is provided adapted to perform prehemming and final hemming and carried b a tool carrier (36, 38). Drive means (24, 26) protrudes up from the press through the opening in the anvil so that a lower inclined leading edge (44, 46) of the tool substantially registers with the upturned edge (14) to be hemmed. The drive means operates so as to force the tool first of all towards the edge so as to bend the upturned edge over until it is bent through substantially 90 degrees from its upstanding position and thereafter to move in a generally downward direction so as to compress the downturned ege. A method of hemming is also described based on this machine.

21 Claims, 2 Drawing Sheets

HEMMING MACHINE

Figure 1:
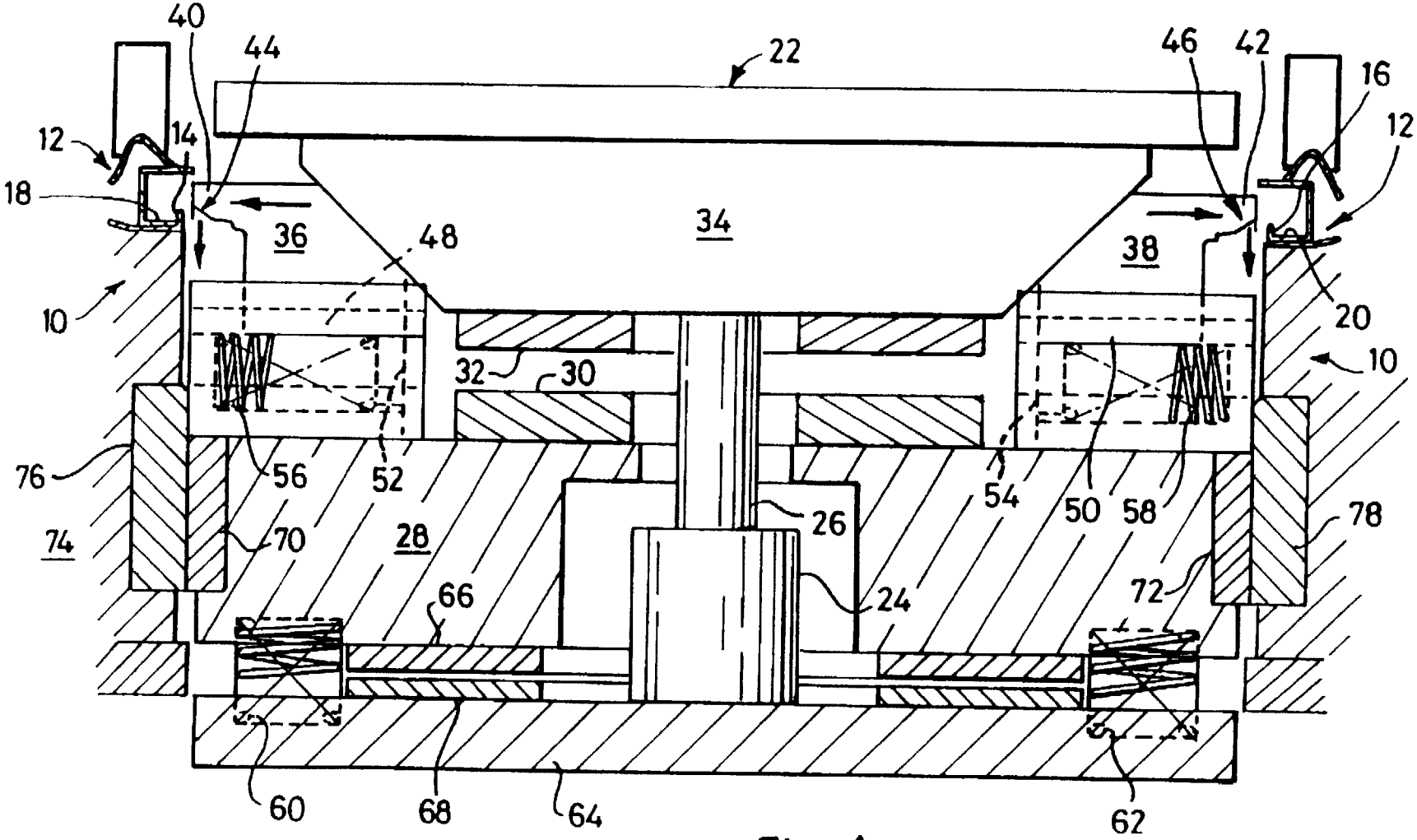

This application is a 371 of PCT/GB95/00289, filed Feb. 13, 1995.

This invention relates to hemming sheet metal and more particularly to a method and apparatus for forming a hem on an edge of an opening in a sheet of a fabricated sheet metal member such as a vehicle body panel.

BACKGROUND TO THE INVENTION

Door, hood and trunk deck lids of vehicles have been formed of one unitary outer skin of sheet metal joined around its periphery to a second inner reinforcing panel of sheet metal by hemming a generally upturned flange along each edge of the outer sheet over an adjacent edge of the inner panel.

Historically this hemming has been accomplished in two separate stages. Prior to performing the first stage, the reinforcing panel is nested within the outer panel fixtured on an anvil die on a base of a prehemming machine. Upon fixturing the assembly, a tool of the machine..commonly referred to as a hemming steel, engages and bends an edge of the outer panel to an acute included angle with respect to the outer panel. After the prehemming of all edges to be joined, both panels are released, transferred to and fixtured in a second hemming machine where a second tool completely bends the prehemmed edge of the outer panel over the peripheral edge of the reinforcing panel to secure and attach the panels together as a unitary structural member for assembly on a vehicle.

Typically, a plurality of both prehemming and final hemming machines are respectively grouped around the periphery of a panel to perform all prehemming and hemming operations for one assembly either sequentially or substantially simultaneously.

More recently, hemming machines have been designed which perform both the prehem and final hem operation in a single machine tool station. Hemming machines of this type vary in the kind of mechanism used and the manner of carrying out the hemming operations. Representative of these hemming machines are US Patents: Kollar et al U.S. Pat. No. 3,191,414; E R St. Denis U.S. Pat. No. 3,276,409; Dacey Jr U.S. Pat. No. 4,706,489 and Dacey Jr U.S. Pat. No. 5,083,355.

Hitherto hemming machines have been used for hemming on external edges. Internal edges have either not been hemmed or have been hemmed on separate machines.

A press for prehemming and final hemming a sheet received on an anvil with separate prehemming and final hemming tools or steels has been proposed in which each of the tools or steels is driven through linkage powered by the same prime mover, such as a cylinder or a screw and servo motor. Each steel is mounted on a separate carrier or subframe pivotally mounted by links in a main frame and each driven through separate toggle joints to produce the force for bending the sheet by the steels. Preferably, to provide a more compact structure the pre-hem carrier is also eccentrically as well as pivotally mounted on the main frame. Preferably, the toggle joints are connected through rocker arms to the prime mover and the linkage provides a dwell in the movement of the prehemming steel so that it does not interfere with movement of the final hemming steel.

SUMMARY OF THE INVENTION

According to one aspect of the present invention there is provided a press for prehemming and final hemming the internal upturned lip of an aperture in a sheet metal component comprising an anvil on which the sheet metal component is held down so that the upturned lip to be hemmed is substantially in alignment with an edge of an opening in the anvil, and a composite hemming tool carried by a tool carrier and adapted to perform prehemming and final hemming steps, characterised by a single drive means which protrudes up from the press through the opening in the anvil so that a lower inclined leading edge of the tool substantially registers with the upturned lip to be hemmed, said single drive means being so operable as to firstly force the tool towards and into engagement with the lip so as to bend the lip over until it is bent through substantially 90° from its upturned position, and thereafter to move the tool in a generally downward direction so as to compress the resulting downturned lip.

The hemming may be for purely decorative or strengthening purposes but alternatively may be used to at least in part secure a second sheet metal member to the first sheet metal member by trapping an edge region of the second member below the downturned edge of the first member.

In a preferred embodiment the tool or steel is mounted in a slideway positioned so as to cause sliding movement of the tool in a direction generally orthogonal to the upstanding edge and spring means is provided urging the tool in a direction away from the edge to hold the tool in a rest position which is sufficiently inboard of the opening within the anvil to allow a sheet metal component to be fitted thereover.

In a particularly preferred embodiment a centre draw is employed driven by a lead screw and servo motor or hydraulic press or the like in which an inclined surface on the underside of the centre draw acts as a cam and as the centre draw is moved in a downward direction engages the rear of a block carried in the slideway and having at its outboard end the said tool or steel, so that with continued downward movement, the block and steel are forced in an outward direction.

The rear of the block may be similarly inclined to present a complementary inclined surface to that on the underside of the centre draw.

Alternatively hardened roller bearing means may be provided between the centre draw and the block so as to transmit thrust to the block.

Whilst the downward movement to the centre draw will simply produce an outward movement of the steel or tool to engage the lip and perform the prehemming step, the final hemming step can only be effectively accomplished by a downward pressure between the underside of the steel and the now largely bent over lip. This second movement and the force required to achieve it may be achieved from the same centre draw if the slide on which the block and steel move is itself carried by an intermediate member which itself is supported on but spaced from the machine frame by apring means, the spacing from the machine frame being by a distance equal to that through which the tool or steel is to move in a downward sense to achieve the final hemming step. By ensuring that the spring means forcing the tool or steel into its rest position exerts a smaller force than the spring means supporting the intermediate member from the machine base, initial downward movement of the centre draw will simply cause the block to move outwardly and there will be no tendency to force the block in a downward direction. All downward movement of the centre draw will be converted into substantially horizontal outward movement. However by arranging that the centre draw engages the intermediate member on which the slide is mounted when the block and tool have moved outwardly by an amount sufficient to force the upstanding edge into a generally horizontal downturned mode so that the generally horizontal underside of the tool now lies over the downturned edge region, further downward movement of the centre draw will cause the intermediate member to be displaced in a downward sense against the second spring means until it bottoms. This will occur when the stop means determining the maximum travel of the intermediate member engage with stop means on the frame and at this point the hemming will have been completed and the centre draw can be allowed to rise causing the steel or tool to retract both upwardly then inwardly to its rest position.

Preferably the block carrying the steel or tool is not stopped in its outward travel but is merely maintained in its outboard mode by the downward displacement of the centre draw and the engagement of the latter against the intermediate support member.

According to a further preferred feature of the invention, two or more such hemming tools may be located around the periphery of a centre draw and adapted to engage different regions of the upstanding edge of the same opening within the sheet received on the anvil and since the centre draw can be designed to a complementary shape to the opening defined by the anvil (and therefore the opening in the sheet), the entire internal edge of an aperture can be hemmed in a single operation.

Although the hemming tool so far described may be mounted within a single machine adapted only to engage and hem the internal edge of an aperture, it is a particularly preferred feature of the invention that the tool may be mounted for hemming an internal edge of an aperture in a sheet member whilst a hemming tool such as has previously been proposed or disclosed in the earlier patent specifications previously mentioned, is adapted for hemming an external edge of the same sheet metal component.

It is thus possible for a machine to be constructed which hems not only the external but internal edges of a sheet steel fabrication in a single operation. Not only does this save time but it also ensures that high tolerances can be maintained between the external edge of a sheet steel fabrication and an internal opening therein.

The invention is of particular application for vehicle door panels which are prefabricated with inner and outer skins of sheet metal and presented to a hemming machine for hemming the outer edges of the door panel and simultaneously some or all of the internal edges of the window opening.

Although of particular merit in this particular application, the invention is of course not in any way limited to forming vehicle door panels.

According to another aspect of the present invention, there is provided a method of hemming an internal edge of an aperture formed in a first sheet metal member in which the edge region to be hemmed has been bent through approximately a right-angle so as to form an upstanding lip which is to be bent over either on itself or so as to trap an edge of another sheet metal member therein, comprising the steps of:

1) locating the first member against an anvil with the upstanding lip near an edge of the anvil,
2) locating a hemming tool having an inclined leading lower edge with the latter in close proximity to the upstanding lip,
3) moving the tool in a generally sideways manner so that the inclined leading underside edge engages the upper edge of the lip and forces the lip down and with continued movement of the tool bends the lip until it is lying substantially flat and is engaged by a generally flat underside of the tool following the inclined leading edge,
4) thereafter moving the tool in a generally vertical direction through a controlled distance to squeeze the downturned lip and the edge of the other sheet metal member in which it is now in contact to form a hem, and
5) thereafter releasing the forces acting on the tool so as to permit the latter to retract vertically and rearwardly away from the bent-over hem, wherein a single drive means (22, 24) acts on the tool, first to drive the tool in an outward generally horizontal manner, and thereafter in a generally vertical manner to squeeze the lip without further outward movement.

The method may be performed substantially simultaneously or in sequence with an external hemming operation while the sheet steel member is carried on the same anvil and held down by the same hold down mechanism.

It is an important feature of the invention that further outward movement of the tool is largely prevented once the generally flat underside of the tool has come into contact with the downturned lip to prevent scuffing and marking so once that condition is reached, the tool is generally moved in a downward sense only so as to squeeze the metal and form the hem.

It is to be understood that whereas references herein so far have described the sheet metal component as being carried by an anvil and the tool being moved in an outward and then downward manner, it is to be understood that the apparatus and the method may be reversed in the sense that the workpiece may be clamped to the underside of an anvil and the hemming tool may be moved outwardly and then upwardly so as to bend outwardly and upwardly or downwardly protruding edge region of an aperture in the sheet workpiece, and the hem is completed by an upward movement of the tool with a generally flat face of the tool engaging the flattened lip. Release of the tool in the opposite sense will allow the workpiece to be removed once the hemming is completed.

Figure 2:
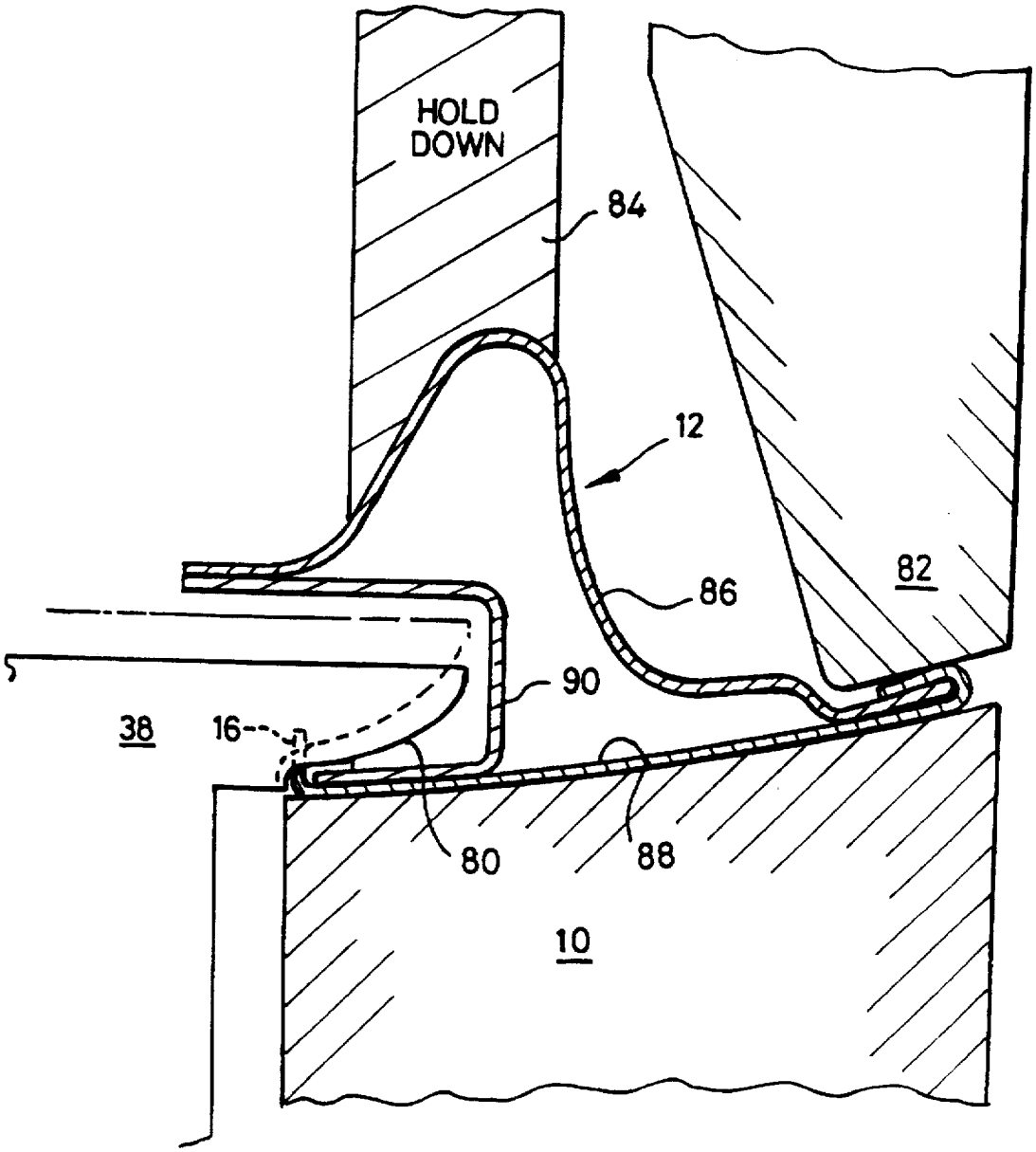

The invention will now be described by way of example with reference to the accompanying drawings in which:

FIG. 1 is a view, diagrammatic in character, showing two internal hemming tools driven by a common centre draw, and FIG. 2 shows an alternative hemming tool shape.

In FIG. 1 the centre draw is driven by a common drive motor and which can be fitted within the anvil of a hemming machine in which a sheet metal fabrication is laid on the anvil and external tooling known per se approaches the exterior of the fabrication to perform hemming around some or all of the outside peripheral region of the fabrication and the tooling according to the present invention simultaneously or sequentially engages the internal periphery of an opening in the sheet metal fabrication to perform a hemming around some or all of the internal opening in the fabrication.

In the drawing an anvil generally designated 10 circumscribes an opening and provides a surface on which a sheet metal fabrication generally designated 12 can rest, the upper surface of the anvil conforming accurately to the underside surface of the fabrication when the latter is laid thereon. An opening in the fabrication defined by an upturned lip 14 at one side and 16 on the other side of the opening registers with the opening defined by the anvil.

The object of the machine is to bend over and flatten the upended edges 14 and 16 to provide a hem and in so doing to trap thereby the edges 18 and 20 of other parts of the sheet steel fabrication 12.

This is achieved by moving downwardly a centre draw generally designated 22 by means of a servo motor drive 24 or hydraulic ram. The latter is joined to the underside of the centre draw via a thrust member 26 which extends through apertures in an intermediate member 28 and hardened steel thrust plates 30 and 32 secured to the top of the intermediate member 28 and the underside of an enlarged head of the centre draw having a generally frusto-conical form with the frusto-conical surface converging in a downward sense.

The shape of the centre draw 22 when viewed in plan is typically substantially the same as the shape of the aperture in the sheet steel fabrication (and anvil) so that the distance between the inclined surface generally designated 34 and the edge of the anvil defining the opening is substantially constant all the way around the anvil.

Blocks, two of which are shown at 36 and 38, carry hemming tools 40 and 42 respectively, the leading underside edges of which are inclined as shown by an angle of approximately 45° as shown at 44 and 46 respectively. The blocks 36 and 38 are mounted in slideways shown diagrammatically at 48 and 50 and each block includes a downwardly extending leg 52 and 54 respectively which engages in a slot housing a compression spring 56 and 58 respectively so that the blocks 36 and 38 are forced by the springs into their inboard position unless forced outwardly by downward movement of the frusto-conical surface 34 of the centre draw 22. To this end the inboard ends of the blocks 36 and 38 are complementarily shaped so as to form a close slipping fit with the frusto-conical surface 34.

Although the surface 34 has been described as frusto-conical it is to be understood that this will only apply if the component aperture is generally circular. If not then the base of the cone will not be a circle but will conform to the shape of the opening but the surface is intended to slope inwardly at the same height at all points around the perimeter of the thrust face formed by the surface 34.

The thrust members 30 and 32 are adjustable so as to control the distance through which the centre draw 22 can move until the surfaces of the members 30 and 32 engage and prevent further downward travel relative to the intermediate member 28.

Thereafter continued downward movement is possible by overcoming the spring force springs such as 60 and 62 mounted between a machine bed and the intermediate member and carrying the intermediate member in a fixed upward position governed by stop means (not shown). Thrust rings 66 and 68 similar to 30 and 32 and adjustable so as to define a precise gap therebetween, are fitted to the upper surface of the machine bed 64 of the underside of the intermediate member 28 and downward travel is terminated when the members 66 and 68 come into contact.

The force required to displace the springs 56 58 etc is calculated so as to be much less than the force required to compress the springs such as 60 and 62 so that there is no tendency for any movement in a downward sense until the blocks 36 and 38 have moved fully over the now downturned lips 14 and 16.

Linear bearing guides are provided at 70 and 72 (and others to provide a complete surrounding support for the intermediate member) to ensure that the latter runs smoothly and accurately within a bounding support 74. As shown bearing surfaces 76 and 78 may be provided for the linear bearing elements 70 and 72.

Although not shown, an outer peripheral edge of the fabrication 12 may be hemmed at the same time as the internal lips 14 and 16 are hemmed by hemming tools (not shown) mounted externally of the anvil 10 in known manner and adapted to move inwardly and downwardly onto external upstanding tabs in manner known per se.

The same drive means 24 may be used to lower the centre draw 22 and the external tooling so that a single drive is used for both internal and external hemming. Alternatively separate drive means may be used for the external hemming tooling.

In FIG. 2 an alternatively shaped hemming tool steel 38 is shown in which the lower leading edge of the steel is smoothly curved at 80 instead of being chamfered as shown at 46 in FIG. 1. This permits a smoother engagement between the upstanding lip 16 and the advancing leading edge.

FIG. 2 also shows the conventional outer steel 82 and a hold down member 84 adapted to clamp the steel fabrication 12 (made up of separate parts 86, 88 and 90) down onto the anvil 10.

We claim:

1. A press for prehemming and final hemming the internal upturned lip (14, 16) of an aperture in a sheet metal component (12) comprising an anvil (10) on which the sheet metal component is held down so that the upturned lip to be hemmed is substantially in alignment with an edge of an opening in the anvil, a composite hemming tool (40, 42) carried by a tool carrier (36, 38) and adapted to perform prehemming and final hemming steps, a single drive means (22, 24) which protrudes up from the press through the opening in the anvil so that a lower inclined leading edge (44, 46) of the tool substantially registers with the upturned lip to be hemmed, said single drive means being so operable as to firstly force the tool outwards and into engagement with the lip (14, 16) so as to bend the lip over until it is bent through substantially 90° from its upturned position, and thereafter to move the tool in a generally downward direction so as to compress the resulting downturned lip, and the tool (40, 42) being mounted in a slideway (48, 50) positioned so as to cause sliding movement of the tool outwards in a direction generally orthogonal to the upturned lip (14, 16).

2. A press according to claim 1, adapted to secure a first sheet metal member to a second sheet metal member by trapping an edge region (18, 20) of the second member below the downturned lip (14, 16) of the first member.

3. A press according to claim 1, wherein first spring means (56, 58) is provided for urging the tool in a direction away from the lip to hold the tool in a rest position which is sufficiently inboard of the opening in the anvil (10) to allow a sheet metal component (12) to be fitted thereover.

4. A press according to claim 3, wherein the single drive means (22, 24) is arranged to overcome the spring means (56, 58) and to move the tool (40, 42) towards and over the upturned lip (14, 16).

5. A press according to claim 4, wherein the single drive means (22, 24) is arranged to move the tool (40, 42) in a downward direction so as to squeeze the downturned lip (14, 16) either against the metal forming the sheet or to trap another sheet of metal therein.

6. A press according to claim 5, wherein the single drive means comprises a centre draw (22) having an inclined surface on the underside thereof which acts as a cam, so that as the centre draw is moved in a downward direction it engages the rear of a block (36, 38) carried in the slideway (48, 50) and having at its outboard end the said tool (40, 42), so that with continued downward movement, the block and tool are forced in an outward direction.

7. A press according to claim 6, wherein the rear of the block (36, 38) is similarly inclined to present a complementary inclined surface to that on the underside of the centre draw (22).

8. A press according to claim 6, wherein a hardened roller bearing is provided between the centre draw (22) and the block (36, 38) so as to transmit thrust to the block.

9. A press according to claim 6, in which the downward movement to the centre draw (22) produces an outward movement of the tool (40, 42) so as to engage the upturned lip (14, 16) and perform a prehemming step, and the final hemming step is accomplished by a downward pressure between the underside of the tool and the now largely bent-over lip, wherein the second movement and the force required to achieve it results from movement of the same centre draw, the slideway (48, 50) on which the block and tool move being mounted on an intermediate member (28) which itself is supported by second spring means (60, 62) at a vertical spacing from the machine frame, the said spacing from the machine frame (64) being a distance equal to that through which the tool is to move in a downward direction to achieve the final hemming step.

10. A press according to claim 9, wherein said first spring means (55, 58) forcing the tool into its rest position is adapted to exert a smaller force than said second spring means (60, 62) supporting the intermediate member from the machine base, so that initial downward movement of the centre draw (22) will simply cause the block (36, 38) to move outwardly and there will be no tendency to force the block in a downward direction, whereby downward movement of the centre draw will be converted into substantially horizontal outward movement.

11. A press according to claim 10, wherein the centre draw is adapted to engage the intermediate member (28) on which the slide is mounted when the block and tool have moved outwardly by an amount sufficient to force the upturned lip (14, 16) into a generally horizontal downturned mode so that the generally horizontal underside of the tool now lies over the downturned edge region, whereby further downward movement of the centre draw (22) will cause the intermediate member to be displaced in a downward sense against the second spring means until it bottoms, and the press is adapted to ensure this will occur when the stop means (66) determining the maximum travel of the intermediate member (28) engages with stop means (68) on the frame (64), and at this point the hemming will have been completed and the centre draw (22) can be allowed to rise causing the tool to retract both upwardly then inwardly to its rest position.

12. A press according to claim 1, wherein the single drive means comprises a centre draw, and the tool carrier (36, 38) carrying the tool is not arrested in its outward travel but is merely maintained in its outboard mode by the downward displacement of the centre draw (22) and the engagement of the latter against an intermediate member (28) on which the tool carrier is mounted.

13. A press according to claim 1, wherein a plurality of internal hemming tools (40, 42) are located around the periphery of a centre draw (22) and adapted to engage different regions of the upturned lip of the same opening within the sheet metal component received on the anvil (10).

14. A press according to claim 13, wherein the centre draw (22) is of a complementary shape to that of the opening defined by the anvil (10), whereby the entire internal lip (14, 16) of an aperture in a component can be hemmed in a single operation.

15. A press wherein a hemming tool, as claimed in claim 1, is mounted within a machine and adapted to engage and hem the internal lip (14, 16) of an aperture in a component, and a further hemming tool is mounted on the machine for hemming an external edge of the same component.

16. A method of hemming a prefabricated vehicle door panel having inner and outer skins of sheet metal which are presented to a hemming machine adapted to hem the outer edges of the two skins to form the door panel and simultaneously some or all of the internal edges of the window opening, by means of a press constructed and operating according to claim 15.

17. A method of hemming an internal edge of an aperture formed in a first sheet metal member in which the edge region to be hemmed has been bent through approximately a right-angle so as to form an upstanding lip (14, 16) which is to be bent over, either on itself or so as to trap an edge of another sheet metal member (18, 20) therein, comprising the steps of:

1) locating the first member against an anvil (10) with the upstanding lip substantially in alignment with an edge of an opening in the anvil, 2) locating a hemming tool (40, 42) having an inclined leading lower edge with the latter in close proximity to the upstanding lip, 3) mounting the tool in a slideway and moving the tool in a generally outwards and sideways manner so that the inclined leading underside edge (44, 46) engages the upper edge of the lip (14, 16) and forces the lip until it is lying substantially flat and is engaged by a generally flat underside of the tool following the inclined leading edge, 4) thereafter moving the tool in a generally vertical direction through a controlled distance to squeeze the downturned lip and the edge of the other sheet metal member in which it is now in contact to form a hem, and 5) thereafter releasing the forces acting on the tool so as to permit the latter to retract vertically and inwardly away from the bent-over hem, wherein a single drive means (22, 24) acts on the tool, first to move the tool in the slideway in said generally outward manner, and thereafter in a generally vertical direction to squeeze the lip without further outward movement.

18. The method according to claim 17, wherein internal and external hemming is performed simultaneously with an external hemming operation while the first sheet metal member is held on the same anvil by the same hold-down mechanism.

19. The method according to claim 17, wherein the internal and external hemmings are performed in sequence.

20. A method according to claim 17, wherein further outward movement of the tool (40, 42) is prevented once the generally flat underside of the tool has come into contact with the downturned lip (14, 16), to prevent scuffing and marking, and once that condition is reached, the tool is moved in a generally vertical sense only, so as to squeeze the metal and form the hem.

21. A method according to claim 17, wherein a sheet metal member is clamped to the underside of an anvil and a hemming tool is moved outwardly and then upwardly so as to bend outwardly and upwardly a downwardly protruding lip of an aperture in the sheet metal member, and the hem is completed by an upward movement of the tool with a generally flat face of the tool engaging the flattened lip.

* * * * *